United States Patent [19]

Frentzel-Beyme et al.

[11] Patent Number: 4,711,081

[45] Date of Patent: Dec. 8, 1987

[54] THREAD BRAKE MECHANISM FOR A SPINDLE ASSEMBLY OF A THREAD PROCESSING MACHINE

[75] Inventors: Johannes Frentzel-Beyme, Monchen-Gladbach; Heinz Stenmans, Grefrath, both of Fed. Rep. of Germany

[73] Assignee: Palitex Project Company GmbH, Krefeld, Fed. Rep. of Germany

[21] Appl. No.: 11,923

[22] Filed: Feb. 6, 1987

[30] Foreign Application Priority Data

Feb. 19, 1986 [DE] Fed. Rep. of Germany ..... 3605193

[51] Int. Cl.[4] ..... D01H 7/86; D01H 13/10; D01H 15/00; B65H 59/26

[52] U.S. Cl. ..... 57/279; 57/58.83; 57/58.86; 242/147 A; 242/149; 242/150 R

[58] Field of Search ..... 57/58.83–58.86, 57/279, 280, 352; 242/147 R, 147 A, 149, 150 R, 151, 153, 152.1, 156–156.2

[56] References Cited

U.S. PATENT DOCUMENTS

| | | | |
|---|---|---|---|
| 2,492,778 | 12/1949 | Agresti et al. | 57/58.86 |
| 2,571,109 | 10/1951 | Carter et al. | 242/150 R |
| 2,736,511 | 2/1956 | Roberts | 242/149 |
| 3,892,371 | 7/1975 | Zollinger | 242/152.1 |
| 4,281,508 | 8/1981 | Frentzel-Beyme | 57/279 |
| 4,287,712 | 9/1981 | Franzen | 57/279 |
| 4,297,834 | 11/1981 | Franzen | 57/279 X |
| 4,338,774 | 7/1982 | Welters | 57/58.86 |
| 4,574,576 | 3/1986 | Nakahara et al. | 57/58.86 |

FOREIGN PATENT DOCUMENTS 857166 11/1952 Fed. Rep. of Germany .

*Primary Examiner*—John Petrakes

*Attorney, Agent, or Firm*—Bell, Seltzer, Park & Gibson

[57] ABSTRACT

A thread brake mechanism is provided which is adapted to be attached to a spindle assembly of a thread processing machine and which is characterized by a construction for use with two independent individual threads which may be fed into the spindle assembly at varying tensions and which applies respective braking forces to the individual threads depending upon the respective feeding tension thereof. The thread brake mechanism includes a tubular housing defining a thread entry aperture on the upper end thereof aligned with the longitudinal central axis thereof, a brake ring member positioned inside the housing and aligned with the central axis and axially spaced from the thread entry aperture and defining an inside inclined braking surface extending downwardly and inwardly in an axially-symmetrical manner, and a disc-shaped brake body member movably positioned inside the brake housing and supported by the brake ring member on the braking surface thereof for axial and radial movement and having a convexly curved outside edge braking surface for cooperating with the braking surface of the brake ring member for receiving the two threads therebetween and applying respective braking forces thereto.

16 Claims, 17 Drawing Figures

THREAD BRAKE MECHANISM FOR A SPINDLE ASSEMBLY OF A THREAD PROCESSING MACHINE

FIELD OF THE INVENTION

This invention relates to a thread brake mechanism adapted to be attached to a spindle assembly of a thread processing machine, particularly a thread entry tube of a two-for-one twister, and characterized by a construction for use with two independent individual threads which may be fed into the spindle assembly at varying tensions and which applies respective braking forces to the individual threads depending upon the respective feeding tensions thereof.

BACKGROUND OF THE INVENTION

In textile thread processing machines, such as two-for-one twisters, thread is pulled from a hollow supply package or packages carried by a stationary carrier mechanism in each of a plurality of spindle assemblies and passed through the hollow center of the supply package and the spindle assembly by directing the thread into the upper end of a thread entry tube and through a yarn passageway in the spindle assembly. During processing of thread in such a spindle assembly of a thread processing machine, it is often desirable to provide a thread brake through which the thread passes in its travel through the spindle assembly for applying additional tension to the thread being processed.

Various constructions of thread brakes suitable for use in spindle assemblies of textile yarn processing machines have heretofore been proposed. However, these previously proposed thread brake mechanisms were not entirely suitable for use with two independent individual threads which may be fed into the spindle assembly at varying tensions, which is often done in various yarn processing operations, for applying respective braking forces to the individual threads depending upon the respective feeding tensions thereof.

An example of such a thread brake mechanism is shown in German Patent DE-PS No. 857 166. In this thread brake mechanism, the brake body rests flat on the surface of the braking ring which has a central aperture and is limited radially in its movement. Upon a rise in the tension of thread being fed through such brake mechanism, the brake body is pushed by the thread being fed between the brake body and the braking ring to such an extent that it abutts against the inner wall of the brake housing and is then raised on one side. This one-sided raising of the brake body leads to a lower loading of the thread and thus to a reduction in the overall braking load. Accordingly, this known thread brake mechanism is only suitable for cases where either an individual thread or else an already plied thread is fed through the brake mechanism to the spindle assembly. If two independent individual threads are fed through this known thread brake mechanism, the brake body of such thread brake mechanism would respond to the tension level of the one or of the other thread and the brake body would display an indifferent behavior with respect to the other thread.

A further example of previously known thread brake mechanisms is disclosed in U.S. Pat. No. 4,287,712, assigned to the assignee of the present application. The brake mechanism of this patent includes a brake body designed as a sphere which is seated in a braking ring having a conical shape on its upper side. This thread brake mechanism is also not suitable for use with two independent individual threads being fed therethrough at varying tensions. It has been shown that, in the case of this known thread brake mechanism, when two threads at varying tension are fed through, the thread with the greater tension remains between the brake body and the braking ring and experiences a still higher tension. On the other hand, the thread being fed therethrough with less tension, which also has a tendency for a loop forming, is tautened in accordance with the level of the braking force produced by the spherical brake body. Its greater length, which it has as a result of the slacker feeding tension, is stripped out only in the direction of the thread afflux. The surplus thread length can only again with subsequent tauter thread portions form the length compensation. This procedure is thus subject to accidents.

OBJECTS AND SUMMARY OF THE INVENTION

It is, therefore, the object of the present invention to provide a thread brake mechanism adapted to be attached to a spindle assembly of a thread processing machine, particularly a thread entry tube of a two-for-one twister, which provides a construction suitable for use with two independent individual threads which may be fed into the spindle assembly at varying tensions and which applies respective braking forces to the individual threads depending upon the respective feeding tensions thereof.

By this invention, it has been found that such a thread brake mechanism can be provided by utilizing the following component structure.

A tubular brake housing is provided which includes means for attaching the brake mechanism to the spindle assembly of a thread processing machine and which defines on its upper end a thread entry aperture aligned with the longitudinal central axis thereof. A brake ring member is positioned inside the brake housing and is aligned with the longitudinal central axis of the brake housing and is axially spaced from the thread entry aperture and defines an inside inclined braking surface extending downwardly and inwardly in an axially-symmetrical manner over the entire braking surface. A disc-shaped brake body member is movably positioned inside the brake housing and supported by the brake ring member on the braking surface thereof for axial and radial movement and has a convexly curved outside edge braking surface for cooperating with the braking surface of the brake ring member for receiving the two threads therebetween and applying respective braking forces thereto.

Such a thread brake mechanism should also preferably provide a construction suitable for use with a pneumatic or air-operated threading mechanism, conventionally used in thread processing machines and particulary two-for-one twisters, for being operable to suck thread into the thread entry tube and blow the thread out through the elongate thread passage-way of the spindle assembly.

For that purpose, the thread brake mechanism of this invention may preferably include a pneumatically-operated piston having a central thread passageway therethrough and carrying the brake ring member on the upper end thereof and being movably positioned in the tubular brake housing in alignment with the longitudinal central axis thereof for selective movement pneumatically from an upper braking position of the brake ring member to a lower threading position in which the braking surface of the brake ring member is out of engagement with the braking surface of the brake body. Such piston includes spring means normally biasing the piston means and the brake ring member into the upper braking position. Also, in lieu of such pneumatically-operated piston, the brake body member of the thread brake mechanism could include an axial central aperture for threading of the threads therethrough and a slot, preferably spiral, extending outwardly from the central aperture through the brake body member to allow passage of the threads from the central aperture outside the brake body member after threading thereof.

Further specific features of the thread brake mechanism and various embodiments thereof will become apparent from the detailed description of preferred embodiments to follow.

BRIEF DESCRIPTION OF THE DRAWINGS

Some of the objects and advantages of this invention having been set forth above, other objects and advantages will become apparent when taken in conjunction with the accompanying drawings, in which.

DESCRIPTION OF THE ILLUSTRATED EMBODIMENTS

While the drawings and specific description to follow will be related to use of the thread brake mechanism of this invention with a two-for one twister textile yarn processing machine, which is the preferred textile yarn processing machine utilizing the brake mechanism of this invention, it is to be understood that this thread brake mechanism could also be utilized on other textile yarn processing machines for which a thread brake mechanism in accordance with this invention is desirable.

Figure 1:
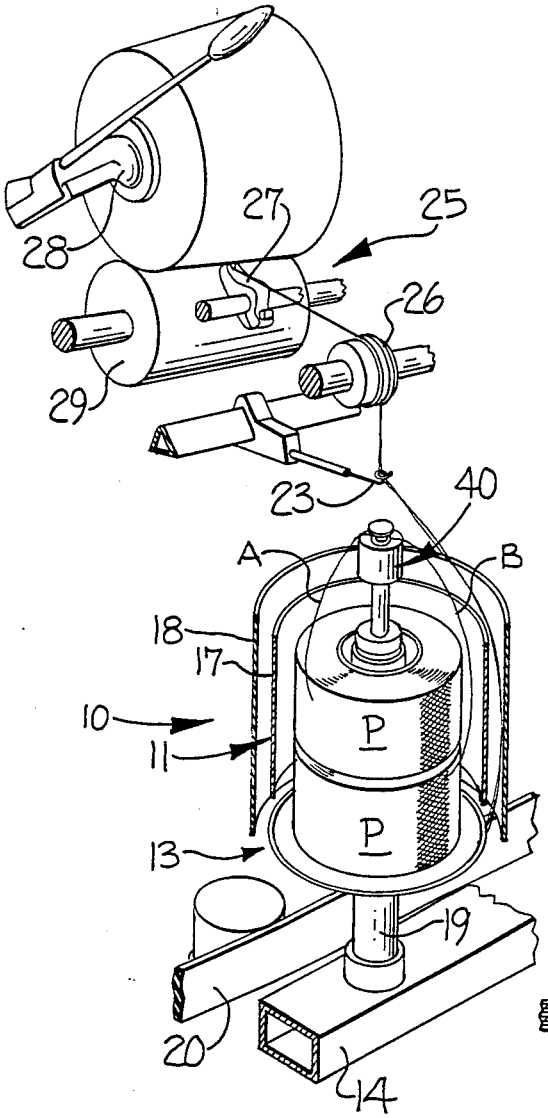
FIG. 1 is a schematic perspective view, partially broken away, illustrating one spindle assembly station of a two-for-one twister textile thread processing machine utilizing a first embodiment of thread brake mechanism of this invention.

Referring now to the drawings, there is illustrated in FIG. 1 a schematic view of one thread processing spindle assembly station of a two-for-one twister textile thread processing machine. A plurality of these thread processing spindle assembly stations are usually provided in generally side-by-side relationship in two rows along the outside of the two-for-one twister textile thread processing machine. A full illustration and description of the entire two-for-one twister textile processing machine is not given herein and is not believed to be necessary for understanding of the present invention, the operation and structure of such a two-for-one twister textile thread processing machine being well understood by those with ordinary skill in the art.

Generally, each of the thread processing spindle assembly stations of the two-for-one twister textile thread processing machine include a spindle assembly 10 having a stationary carrier mechanism 11 on which a hollow supply package or packages P of threads A, B are mounted. The spindle assembly 10 further includes a rotor mechanism 13 which is mounted to the machine frame 14 and constructed for rotation relative to the stationary carrier mechanism 11.

Figure 2:
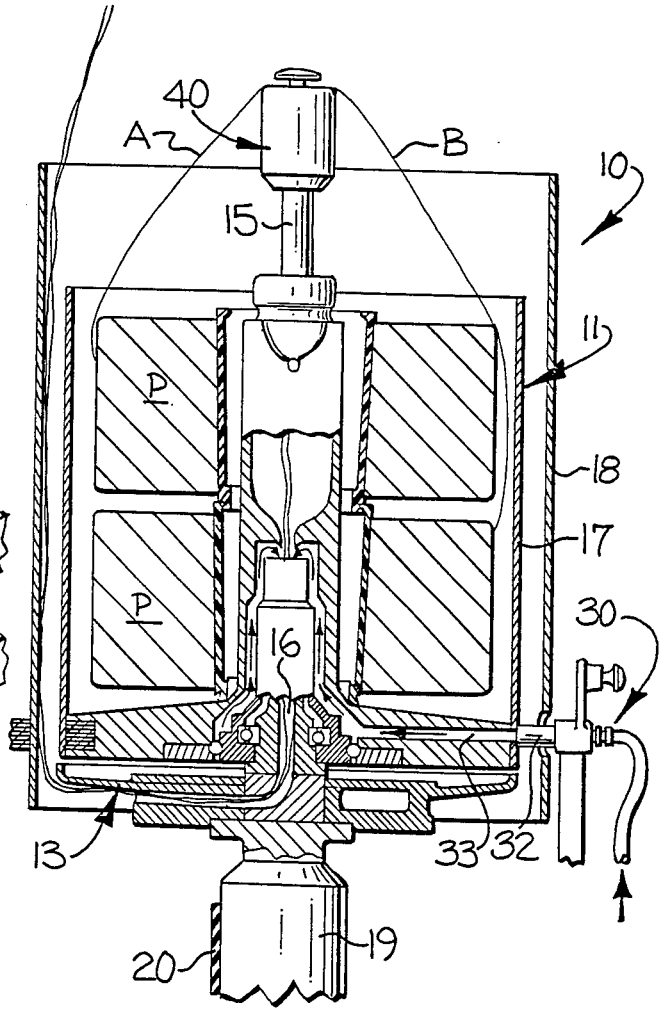
FIG. 2 is an enlarged cross-sectional elevational view of the spindle assembly shown in FIG. 1.

The carrier mechanism 11 further includes a hollow thread entry tube 15 extending axially through a part of the uppermost thread package P and providing a passageway for the thread therethrough. The thread passageway of the thread entry tube 15 communicates with a thread passageway 16 in the carrier mechanism 11 and the rotor mechanism 13 for providing an elongate passageway extending axially through the spindle assembly 10 and radially outwardly beneath the base of the lowermost package P (FIG. 2). The carrier mechanism 11 further includes a basket device 17 surrounding the thread supply packages P and a balloon limitor device 18 surrounding the basket device 17. The rotor mechanism 13 includes a whorl 19 which is rotatably driven by a drive belt 20 held in selective engagement therewith by a roll 21 in a known manner.

When the threads A, B are threaded through the spindle assembly 10 by passing through the thread entry tube 15 and the thread passageway 16 and the rotor mechanism 13 is rotated, the threads A, B are drawn from the packages P and passed downwardly through the yarn thread entry tube 15 and the thread passageway 16 and emerge from the rotor mechanism 13 and form a rotating balloon of threads between the basket device 17 and the balloon limitor 18. The threads A, B are then directed through a thread guide eyelet device 23 located above the spindle assembly 10 for limiting the upper end of the rotating balloon of thread after the threads A, B pass therethrough. The threads A, B are then directed to a takeup mechanism 25 which includes a pretakeup roll 26, a traversing mechanism 27, a package roll device 28 for forming a package of processed threads A, B and which is rotatably driven by a drive roll 29. As is well understood by those with ordinary skill in the art, a two-for-one twist is inserted in the threads A, B as they travel through the spindle assembly 10 and to the takeup mechanism 25 in a manner well understood by those with ordinary skill in the art.

To assist in threading of the threads A, B from the packages P through the thread entry tube 15 and passageway 16 of the spindle assembly 10 during a periodic thread-up operation when rotation of the rotor mechanism 13 is stopped, the spindle assembly 10 is further provided with a pneumatic threading mechanism, generally indicated at 30. This threading mechanism 30 may be constructed generally in accordance with the threading mechanism disclosed in U.S. Pat. No. 4,287,712, discussed above. The threading mechanism 30 includes an air injector nozzle (not shown completely) formed within the tubular housings of the carrier mechanism 11 and rotor mechanism 13 and communicating with the thread passageway 16. The threading mechanism 30 may further include a selectively movable connector member 32 which is connected to a compressed air supply (not shown) and positioned for movement into and out of connecting engagement with the outer end of an air duct 33 extending radially through the bottom portion of the carrier mechanism 11 and upwardly to communicate with the air injector nozzle within the tubular housings of the carrier mechanism 11 and the rotor mechanism 13.

When compressed air is selectively supplied by the connector member 32 through the air duct 33 to the injector nozzle within the tubular housing, a suction is created through the thread entry tube 15 for sucking threads A, B into and through such thread entry tube and a positive air flow is created through thread passageway 16 for blowing the threads A, B therethrough and out of the spindle assembly 10 for a threading-up operation. This threading-up operation and the threading mechanism 30 are well known to those with ordinary skill in the art and further details and explanation thereof is not believed necessary for a full understanding of the present invention.

Figure 8:
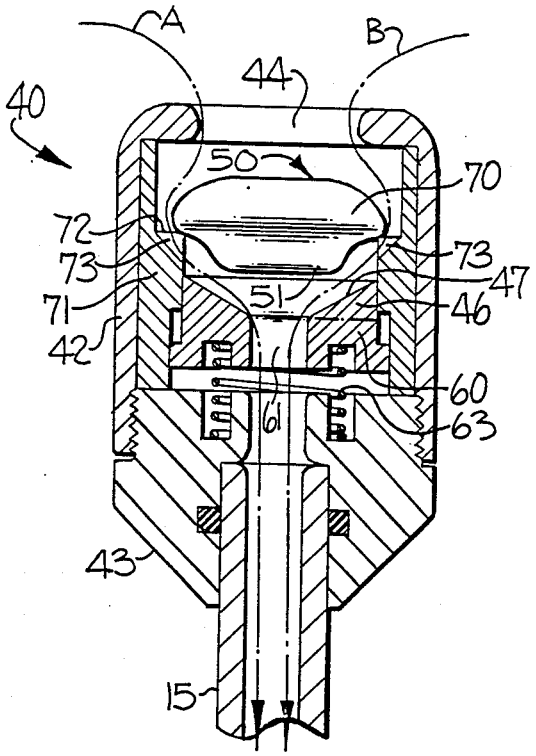
FIG. 8 is a vertical section view of a second embodiment of the thread brake mechanism and showing the components thereof in the threading position.
Figure 9:
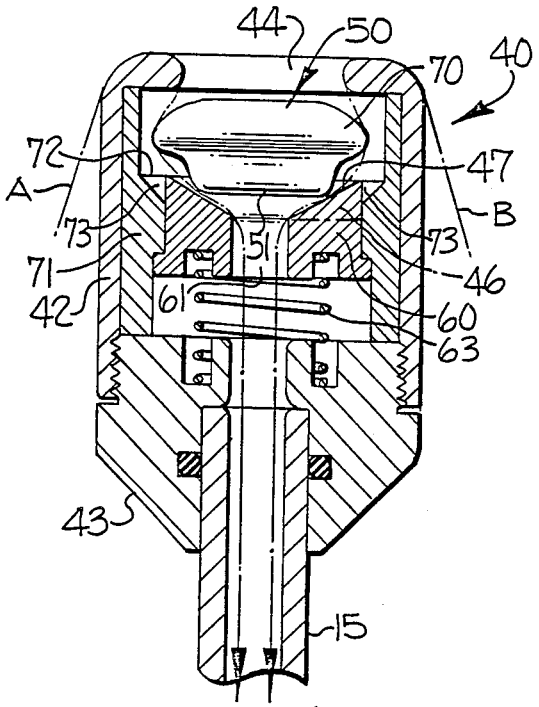
FIG. 9 is a vertical sectional view of the second embodiment of the thread brake mechanism with the components thereof in the braking position.
Figure 10:
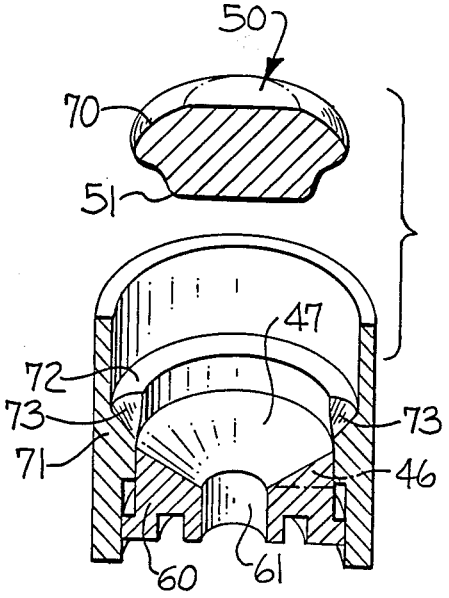
FIG. 10 is an exploded view of some of the components of the second embodiment of the thread brake mechanism.
Figure 11:
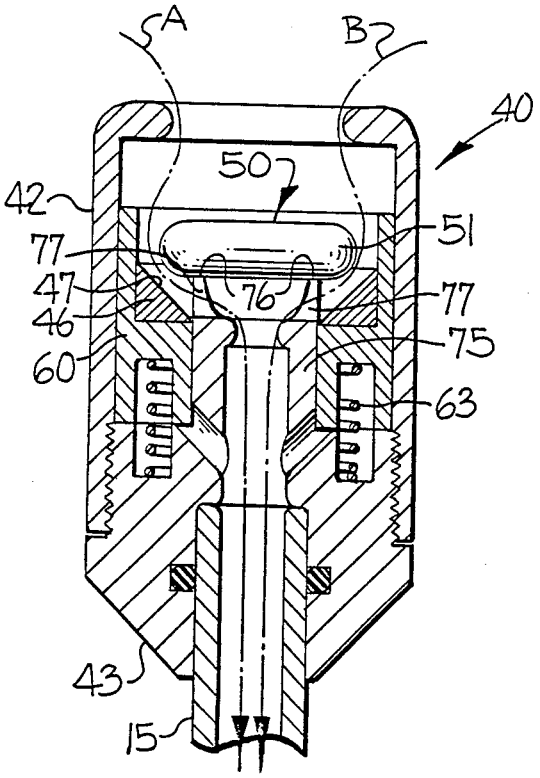
FIG. 11 is a vertical cross sectional view illustrating a third embodiment of the thread brake mechanism with the components thereof in the threading position.
Figure 12:
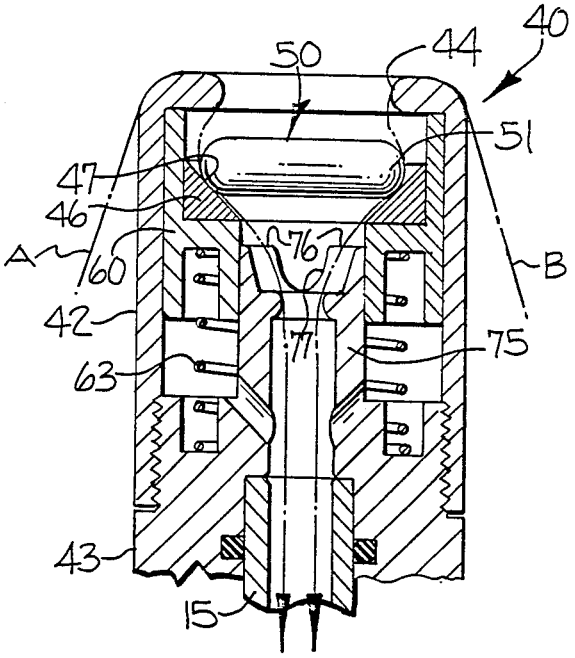
FIG. 12 is a vertical sectional view of the third embodiment of the thread brake mechanism with the components thereof in the braking position.
Figure 13:
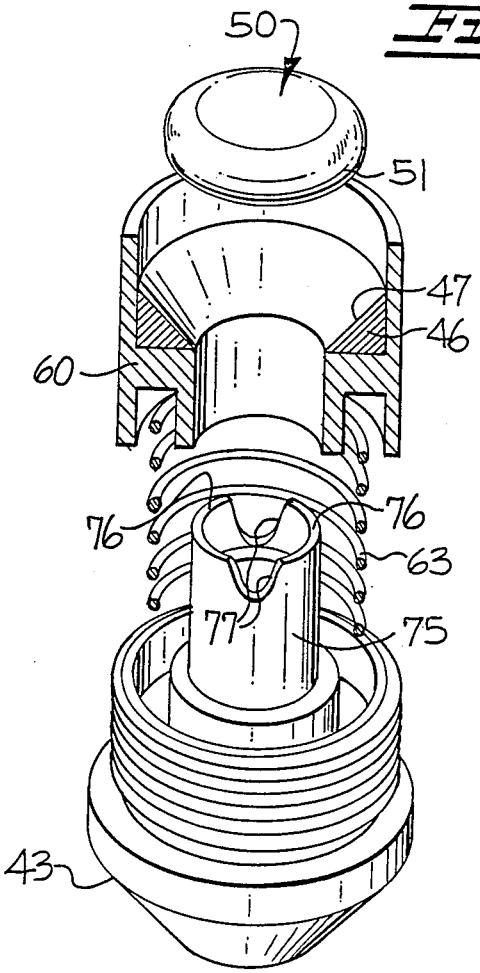
FIG. 13 is an exploded view of some of the components of the third embodiment of the thread brake mechanism.
Figure 14:
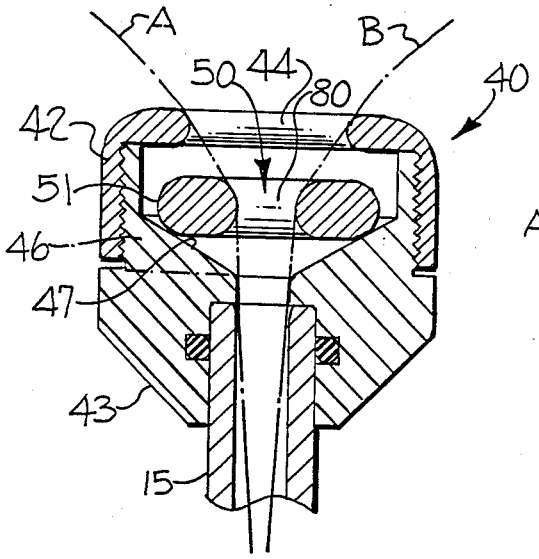
FIG. 14 is a vertical sectional view of a fourth embodiment of the thread brake mechanism with the components thereof in the threading position.
Figure 15:
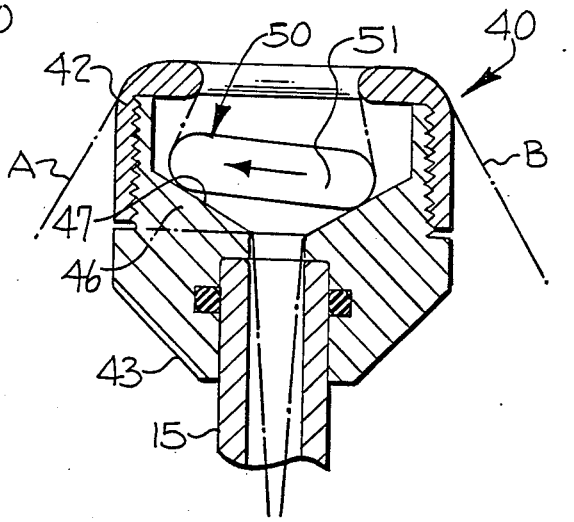
FIG. 15 is a vertical sectional view of the fourth embodiment of the thread brake mechanism with the components thereof in the braking position and with threads being fed therethrough under different tensions.
Figure 16:
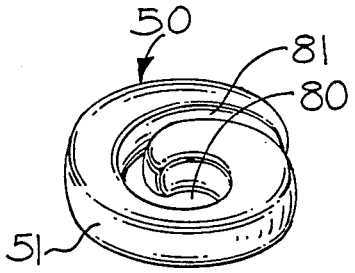
FIG. 16 is a perspective view of the brake body member of the fourth embodiment of the thread brake mechanism.

In accordance with the present invention, a thread brake mechanism 40 is attached to the spindle assembly 10, preferably to the yarn entry tube 15, and, as discussed above, is characterized by a construction for use with two independent individual threads A, B which may be fed into the spindle assembly 10 at varying tensions and which applies respective braking forces to the individual threads A, B depending upon the respective feeding tension thereof. A first embodiment of such thread brake mechanism is illustrated in FIGS. 1–7, a second embodiment of such thread brake mechanism 40 is illustrated in FIGS. 8–10, a third embodiment of such thread brake mechanism 40 is illustrated in FIGS. 11–13 and a fourth embodiment of such thread brake mechanism 40 is illustrated in FIGS. 14–16. It is to be understood that other embodiments of a thread brake mechanism may also come within the novel concepts of the present invention, as will be apparent from the description to follow.

All of the embodiments of a thread brake mechanism 40 include certain common components which will now be described and which have been given like reference numeral in all Figures of the drawings.

A tubular brake housing 42 is provided in all embodiments and include means for attaching the brake mechanism 40 to the spindle assembly, preferably to the yarn entry tube 15 thereof. This attachment means may include a sleeve member 43 onto which the tubular brake housing 42 may be screwed and which is adapted to fit around and be retained on the upper end of the thread entry tube 15. The tubular brake housing 42 further defines on the upper end thereof a thread entry aperture 44 aligned with the longitudinal central axis of the tubular brake housing 42.

All embodiments of the thread brake mechanism 40 further include a brake ring member 46 positioned inside the brake housing 42 and aligned with the longitudinal central axis of the brake housing 42 and axially spaced from the thread entry aperture 44 and defining an inside inclined braking surface 47, preferably conical, extending downwardly and inwardly in an axially-symmetrical manner over the entire braking surface.

All embodiments of the thread brake mechanism 40 further include a disc-shaped brake body member 50 movably positioned inside the brake housing 42 and supported by the brake ring member 46 on the braking surface 47 thereof for axial and radial movement and having a convexly curved outside edge braking surface 51 for cooperating with the braking surface 47 of the brake ring member 46 to receive the two threads A, B therebetween and apply respective braking forces thereto.

Figure 4:
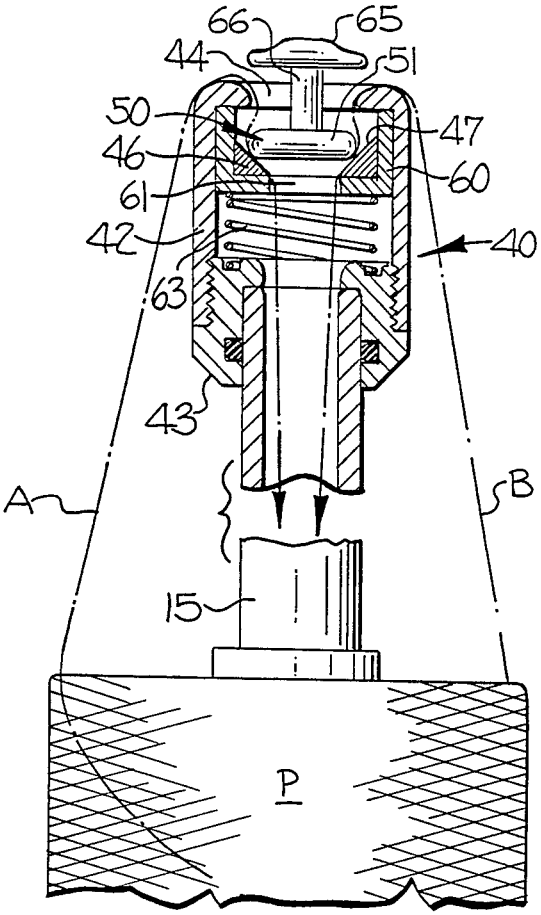
FIG. 4 is a somewhat schematic, partial sectional view, showing the first embodiment of the thread brake mechanism and a portion of the spindle assembly with the components of the thread brake mechanism in thread braking position.
Figure 6:
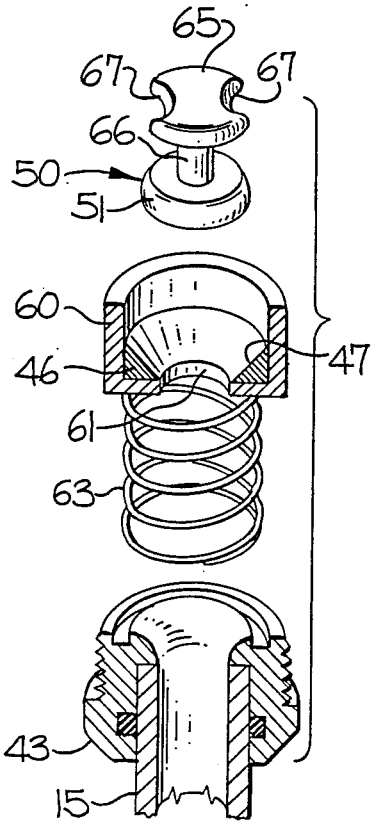
FIG. 6 is an exploded view of some of the elements of the first embodiment of the thread brake mechanism.
Figure 5:
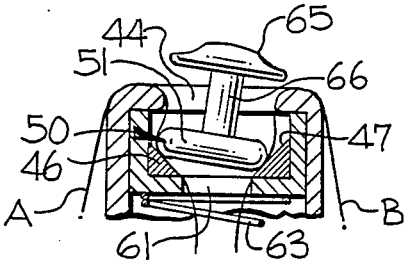
FIG. 5 is a sectional detail of a portion of the first embodiment of the thread brake mechanism showing the components thereof in the braking position when two threads are being fed therethrough of different tensions.
Figure 7:
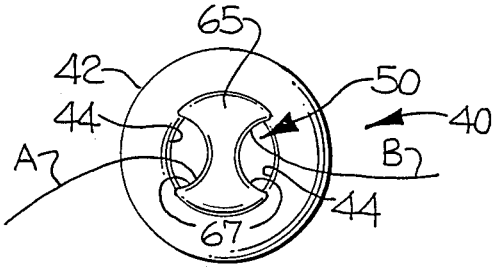
FIG. 7 is a top plan view of the first embodiment of the thread brake mechanism.

The behavior and relative positions of the components of the thread brake mechanism 40 for all embodiments may be seen with reference to FIGS. 4 and 5. In FIG. 4, the brake body member 50 is shown in the position thereof relative to the brake ring member 46 which occurs when the threads A, B are being fed into the spindle assembly 10 at generally the same tension. In contrast thereto and in FIG. 5, the brake body member 50 is shown in the position thereof relative to the brake ring member 46 which occurs when the thread B is being fed into the spindle assembly 10 at a greater tension than the thread A. The result of these varying feeding tensions of threads A, B is that the brake body member 50 is pushed radially to the side in the direction of the arrow shown in FIG. 5, which causes the thread A to have a larger looping angle around the braking surface 51 of the brake body member 50 to thereby create a greater braking action on the thread A.

Figure 17:
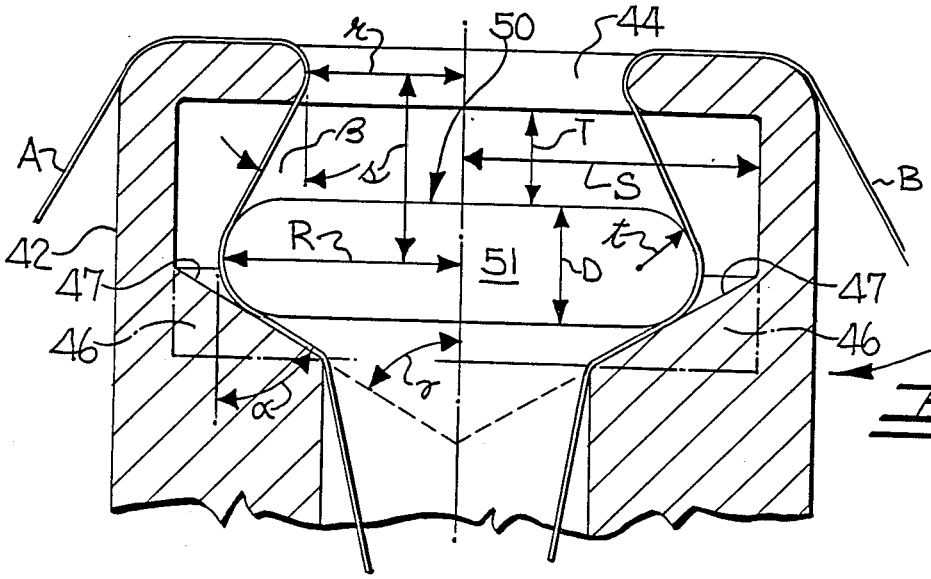
FIG. 17 is a schematic, sectional view illustrating the upper region of the thread brake mechanism in accordance with this invention and showing the geometric conditions and relationships for all embodiments.

Referring now to the schematic illustration of the thread brake mechanism 40 in FIG. 17, the geometric relationships which are desirable for the components of all embodiments of the thread brake mechanism 40 to obtain the desired results of this invention will be explained in more detail.

The thread entry aperture 44 of the brake housing 42 has rounded edges and a minimum aperture radius of r. The interior of the brake housing 42 in the upper part thereof is circular with an inside radius S. The braking surface 47 of the brake ring member 46 is preferably conical to define an inclined surface extending downwardly and inwardly in an axially-symmetrical manner over the entire braking surface 47. This conical braking surface 47 is produced with a cone having an aperture angle of $\gamma$. The brake body member 50 which is positioned inside the brake housing 42, has a thickness D in the axial direction and a maximum radius R. The braking surface 51 of the brake body member 50 has a radius of curvature t. The distance of the central plane of the brake body 50 from the central plane of the thread entry aperture 44 is s, while the distance between the upper side of the brake body member 50 from the lower edge of the thread entry aperture 44 is T.

The looping angle between threads A, B and the brake body member 50 is composed substantially of two portions, namely the angle $\alpha$ which corresponds to half of the aperture $\gamma$ of the conical braking surface 47 and the angle $\beta$ which is given by the equation:

$$(R-r)/s=tg\beta$$

This means that the looping angle is dependent upon the aperture angle $\gamma$ of the conical braking surface 47 of the brake ring member 46 on the one hand and the ratio of the difference between the maximum radius R of the brake body member 50 and the minimum radius r of the thread entry aperture 44 to the axial distance s of the central plane of the brake body member 50 from the central plane of the thread entry aperture 44. The theoretical limiting values for the angles $\alpha$ and $\beta$ are in each case 90°, which in practice cannot be achieved.

It has been determined that the aperture angle $\gamma$, determining the angle $\alpha$, of the conical braking surface 47 of the brake ring member 46 advantageously lies in the region between 60° and 120°, while the above-mentioned ratio determining the angle $\beta$ advantageously lies between 0.15 and 1.00. Thus, a value range between 30°–60° is obtained for $\alpha$ and a value range between 9°–45° is obtained for $\beta$.

The difference R minus S between the maximum radius of the brake body member 50 and the inside radius of the tubular brake housing 42, as well as the axial distance T between the upper side of the brake body member 50 and the lower edge of the thread entry aperture 44 and the radius of curvature t of the braking surface 51 of the brake body member 50 are adapted to the diameter of the threads A, B being fed through the brake mechanism 40 and desirably correspond to approximately 10 to 50 times the thread diameter. The maximum diameter of the brake body member 50, in other words the magnitude of 2 times R, is about 3 to 5 times as great as the thickness diameter D of the brake body member 50 in the axial direction.

In all embodiments of the thread brake mechanism 40 disclosed herein, the braking surface 47 of the brake ring member 46 could be constructed either concave or convex as long as such braking surface 47 is symmetrical with respect to the central axis through the thread brake mechanism 40 and above similar considerations would apply.

Referring now specifically to the first, second and third embodiments of the thread brake mechanism 40 illustrated respectively in FIGS. 1–7, 8–10 and 11–13, the thread brake mechanism 40 of these embodiments further includes a pneumatically-operated piston 60 having a central thread passageway 61 therethrough and constructed for carrying or being integral with the brake ring member 46 and being movably positioned within the tubular brake housing 42 in alignment with the longitudinal central axis thereof for movement, upon actuation of the pneumatic threading mechanism 30 creating a suction through the yarn entry tube 15 and thus through the brake housing 42 of the thread brake mechanism 40, from an upper braking position (FIGS. 4, 9, 12), of the brake ring member 46 and the brake body member 50 to a lower threading position (FIGS. 3, 8, 11) in which the braking surface 47 of the brake ring member 46 is out of engagement with the braking surface 51 of the brake body member 50. The piston 60 further includes a spring 63 which normally biases the piston 60 and the brake ring member 46 into the upper braking position (FIGS. 4, 9, 12), but which allows pneumatic movement of the piston 60 and brake ring member 46 by the created suction against the bias thereof upon selective actuation of the pneumatic threading mechanism 30 to the lower threading position (FIGS. 3, 8, 11).

Figure 3:
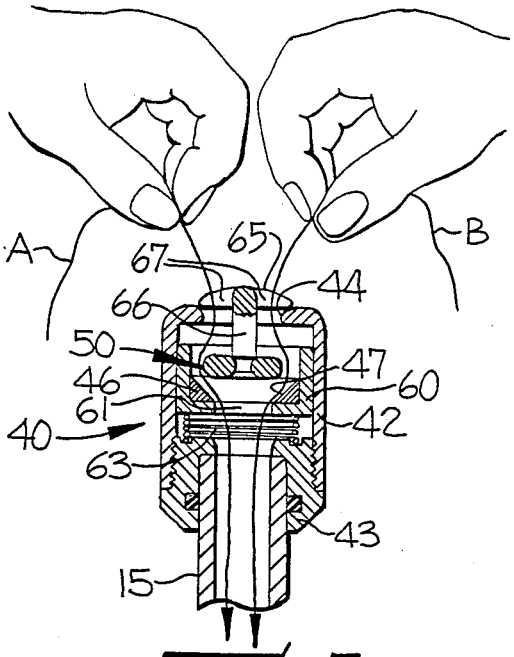
FIG. 3 is a vertical sectional view taken through the first embodiment of thread brake mechanism illustrated in FIGS. 1 and 2 and showing the components of such thread brake mechanism in position for threading of threads therethrough.

Referring now specifically to the first embodiment of thread brake mechanism 40 illustrated in FIGS. 1–7, the brake body member 50 further includes a retaining knob 65 of greater diameter than the thread entry aperture 44 of the brake housing 42, and a stem member 66 extending through the thread entry aperture 44 of the brake housing 42 and connecting the retaining knob 65 to the disc-shaped brake body member 50. The stem member 66 is of a desired length to position the retaining knob 65 above the brake housing 42 when the piston 60 and brake ring member 46 are in their upper braking position (FIG. 4) and to allow the retaining knob 65 to rest on the upper surface of the brake housing 42 around the thread entry aperture 44 and hold the brake body member 50 and the braking surface 51 thereof spaced from the brake ring member 46 and the braking surface 47 thereof for threading of the threads A, B when the piston 60 and brake ring member 46 are in their lower threading position (FIG. 3). The retaining knob 65 includes at least two recesses 67 in the outer edge thereof in alignment with the thread entry aperture 44 for allowing threading of the threads A, B therethrough (FIG. 3). As shown in FIGS. 3–6, the piston 60 of this first embodiment of thread brake mechanism 40 is of a generally tubular construction having an inwardly extending lower leg portion to provide a generally L-shaped cross section on each side thereof and carries the separate brake ring member 46 on the lower leg portion thereof.

Referring now specifically to the second embodiment of thread brake mechanism 40 illustrated in FIGS. 8–10, the brake body member 50 further includes a supporting collar portion 70 integral therewith and being of greater diameter than the braking surface 51 thereof. The brake mechanism 40 further includes a tubular insert piece 71 mounted on the inside surface of the tubular brake housing 42 and around the brake ring member 46 and piston 60, which are integrally formed with each other in this embodiment. The insert piece 71 defines an inside supporting surface 72 for receiving the supporting collar portion 70 of the brake body member 50 for holding the brake body member 50 and the braking surface 51 thereof spaced from the brake ring member 46 and braking surface 47 thereof for threading of the threads A, B when the piston 60 and brake ring member 46 are in their lower threading position (FIG. 8). The supporting surface 72 of the insert piece 71 includes at least two recesses 73 therein for threading of the threads A, B therethrough (FIG. 8).

Referring now specifically to the third embodiment of thread brake mechanism 40 illustrated in FIGS. 11–13, the thread brake mechanism 40 further includes a support tube member 75 mounted inside the brake housing 42 and being of smaller diameter than and in axial alignment with the inside of the brake ring member 46. This support tube 75 defines an upper supporting surface 76 for receiving and holding the brake body member 50 and braking surface 51 thereof spaced from the brake ring member 46 and braking surface 47 thereof for threading of the threads A, B when the piston 60 and brake ring member 46 are in their lower threading position (FIG. 11). The support tube member 75 has at least two by-pass apertures 77 therein and through the supporting surface 76 for threading of the threads A, B therethrough (FIG. 11).

Referring now to the fourth embodiment of thread brake mechanism 40 illustrated in FIGS. 14–16, this embodiment contains no piston member 60 and the brake ring member 46 is formed as an integral part of the sleeve member 43 or attachment means of the brake mechanism 40. The disc-shaped brake body member 50 includes an axial central aperture 80 for threading of the threads A, B therethrough (FIG. 14) and a slot 81 (FIG. 16) extending outwardly from the central aperture 80 through the brake body member 50 to allow passage of the threads A, B from the central aperture 80 outside the brake body member 50 after threading thereof (FIG. 15). Preferably, the slot 81 comprises a spiral shape.

Accordingly, a thread brake mechanism 40 and various embodiments thereof have been provided by this invention which are adapted to be attached to a spindle assembly 10 of a thread processing machine, particularly a thread entry tube 15 of a two-for-one twister, and which is characterized by a construction for use with two independent individual threads A, B which may be fed into the spindle assembly 10 at varying tensions and which applies respective braking forces to the individual threads A, B depending upon the respective feeding tensions thereof.

In the drawings and specification there have been set forth preferred embodiments of this invention, and although specific terms are employed, they are used in a generic and descriptive sense only and not for purposes of limitation.

What is claimed is:

1. A thread brake mechanism adapted to be attached to a spindle assembly of a thread processing machine, particularly a thread entry tube of a two-for-one twister, and characterized by a construction for use with two independent individual threads which may be fed into the spindle assembly at varying tensions and which applies respective braking forces to the individual threads depending upon the respective feeding tension thereof; said thread brake mechanism comprising:

a tubular brake housing including means for attaching said brake mechanism to the spindle assembly of a thread processing machine and defining on the upper end thereof a thread entry aperture aligned with the longitudinal central axis thereof;

a brake ring member positioned inside said brake housing and being aligned with the longitudinal central axis of said brake housing and axially spaced from said thread entry aperture and defining an inside inclined braking surface extending downwardly and inwardly in an axially-symmetrical manner over the entire braking surface; and a disc-shaped brake body member movably positioned inside said brake housing and supported by said brake ring member on said braking surface thereof for axial and radial movement and having a convexly curved outside edge braking surface for cooperating with said braking surface of said brake ring member for receiving the two threads therebetween and applying respective braking forces thereto.

2. A thread brake mechanism adapted to be attached to a spindle assembly of a thread processing machine, particularly a thread entry tube of a two-for-one twister, and characterized by a construction for use with two independent individual threads which may be fed into the spindle assembly at varying tensions and which applies respective braking forces to the individual threads depending upon the respective feeding tension thereof; said thread brake mechanism comprising:

a tubular brake housing including means for attaching said brake mechanism to the spindle assembly of a thread processing machine and defining on the upper end thereof a thread entry aperture aligned with the longitudinal central axis thereof;

a brake ring member positioned inside said brake housing and being aligned with the longitudinal central axis of said brake housing and axially spaced from said thread entry aperture and defining an inside inclined braking surface extending downwardly and inwardly in an axially-symmetrical manner over the entire braking surface;

a disc-shaped brake body member movably positioned inside said brake housing and supported by said brake ring member on said braking surface thereof for axial and radial movement and having a convexly curved outside edge braking surface for cooperating with said braking surface of said brake ring member for receiving the two threads therebetween and applying respective braking forces thereto; and pneumatically-operated piston means having a central thread passageway therethrough and carrying said brake ring member and being movably positioned in said tubular brake housing in alignment with the longitudinal central axis thereof for selective movement pneumatically from an upper braking position of said brake ring member to a lower threading position in which said braking surface of said brake ring member is out of engagement with said braking surface of said brake body member, said piston means including spring means normally biasing said piston means and said brake ring member into the upper braking position.

3. In a tow-for-one twister textile yarn processing machine having a plurality of spindle assemblies, each including a thread entry tube and an elongate thread passageway extending from said thread entry tube through said spindle assembly and including a selectively-operated pneumatic threading mechanism having a compressed air-operated injector nozzle for sucking thread into said thread entry tube and blowing thread out through said passageway for automatically threading the thread through said spindle assembly during a thread-up operation; the combination therewith of a thread brake mechanism attached to said yarn entry tube and characterized by a construction for use with two independent individual threads which may be fed into said spindle assembly at varying tensions and which applies respective braking forces to the individual threads depending upon the respective feeding tension thereof, said thread brake mechanism comprising a tubular brake housing including means for attaching said brake mechanism to said thread entry tube of said spindle assembly and defining on the upper end thereof a thread entry aperture aligned with the longitudinal central aixs thereof, a brake ring member positioned inside said brake housing and being aligned with the longitudinal central axis of said brake housing and axially spaced from said thread entry aperture and defining an inside inclined braking surface entending downwardly and inwardly in an axially-symmetrical manner over the entire braking surface, a disc-shaped brake body member movably positioned inside said brake housing and supported by said brake ring member on said braking surface thereof for axial and radial movement and having a convexly curved outside edge braking surface for cooperating with said braking surface of said brake ring member for receiving the two threads therebetween and applying respective braking forces thereto, and pneumatically-operated piston means having a central thread passageway therethrough and carrying said brake ring member and being movably positioned in said tubular brake housing in alignment with the longitudinal central axis thereof for movement, upon actuation of said compressed air-operated injector nozzle of said threading mechanism, from an upper braking position of said brake ring member to a lower threading position in which said braking surface of said brake ring member is out of engagement with said braking surface of said brake body member, said piston means including spring means normally biasing said piston means and said ring brake member into the upper braking position.

4. A thread brake mechanism, as set forth in claim 1, 2 or 3, in which said thread entry aperture of said tubular brake housing has a radius smaller than or equal to the maximum radius of said disc-shaped brake body member.

5. A thread brake mechanism, as set forth in claim 1, 2 or 3, in which said braking surface of said brake ring member comprises a conical shape.

6. A thread brake mechanism, as set forth in claim 5, in which said conical braking surface of said brake ring member includes an aperture angle of between 60° and 120°.

7. A thread brake mechanism, as set forth in claim 1, 2 or 3, in which the ratio of the difference from the maximum radius of said disc-shaped brake body member and the minimum radius of said thread entry aperture of said tubular brake housing to the axial distance of the central plane of said brake body member from the central plane of said thread entry aperture is between 0.15 to 1.00.

8. A thread brake mechanism, as set forth in claim 1, 2 or 3, in which the difference between the maximum radius of said disc-shaped brake body and the inside radius of said tubular brake housing is 10 to 50 times the diameter of the threads being fed through said brake mechanism.

9. A thread brake mechanism, as set forth in claim 1, 2 or 3, in which the axial distance between the upper side of said disc-shaped brake body member and the lower edge of said thread entry aperture of said tubular brake housing is 10 to 50 times the diameter of the threads being fed through said brake mechanism.

10. A thread brake mechanism, as set forth in claim 1, 2 or 3, in which the radius of curvature of said convexly curved outside edge braking surface of said brake body member is 10 to 50 times the diameter of the threads being fed through said brake mechanism.

11. A thread brake mechanism, as set forth in claim 1, 2 or 3, in which the maximum diameter of said disc-shaped brake body member is approximately 3 to 5 times as great as the thickness thereof in the axial direction.

12. A thread brake mechanism, as set forth in claims 2 or 3, in which said brake body member further includes a retaining knob of greater diameter than said thread entry aperture of said brake housing, and a stem member extending through said thread entry aperture of said brake housing and connecting said retaining knob to said brake body member and being of a length to position said retaining knob above said brake housing when said piston and brake ring member are in their upper braking position and to allow said retaining knob to rest on said brake housing around said thread entry aperture and hold said brake body member spaced from said brake ring member for threading of the threads when said piston and brake ring member are in their lower threading position, and said retaining knob having at least two recesses in the outer edge thereof in alignment with said thread entry aperture for threading of the threads therethrough.

13. A thread brake mechanism, as set forth in claim 2 or 3, in which said brake body member further includes a supporting collar portion of greater diameter than said braking surface thereof, and in which said brake mechanism further includes a tubular insert piece mounted on the inside surface of said tubular brake housing around said brake ring member and defining an inside supporting surface for receiving said supporting collar portion and holding said brake body member spaced from said brake ring member for threading of the threads when said piston and brake ring member are in their lower threading position, said supporting surface having at least two recesses therein for threading of the threads therethrough.

14. A thread brake mechanism, as set forth in claim 2 or 3, in which said brake mechanism further includes a support tube mounted inside said brake housing and being of smaller diameter than and in axial alignment with the inside of said brake ring member and defining an upper supporting surface for receiving and holding said brake body member spaced from said brake ring member for threading of the threads when said piston and brake ring member are in their lower threading position, said support tube having at least two by-pass apertures therein through said supporting surface for threading of the threads therethrough.

15. A thread brake mechanism, as set forth in claim 1, in which said brake body member includes an axial central aperture for threading of the threads therethrough and a slot extending outwardly from said central aperture through said brake body member to allow passage of the threads from said central aperture outside said brake body member after threading thereof.

16. A thread brake mechanism, as set forth in claim 15, in which said slot comprises a spiral shape.

* * * * *